US011834750B2

(12) United States Patent
Huang et al.

(10) Patent No.: US 11,834,750 B2
(45) Date of Patent: Dec. 5, 2023

(54) METHOD FOR GENERATING ETHYLENE BY ELECTROCHEMICAL SELECTIVE HYDROGENATION OF ACETYLENE

(71) Applicant: Hunan University, Changsha (CN)

(72) Inventors: Binbin Huang, Changsha (CN); Xuxu Wang, Changsha (CN); Xiaojia Lei, Changsha (CN); Chao Lei, Changsha (CN)

(73) Assignee: HUNAN UNIVERSITY, Changsha (CN)

( * ) Notice: Subject to any disclaimer, the term of this patent is extended or adjusted under 35 U.S.C. 154(b) by 0 days.

(21) Appl. No.: 18/120,544

(22) Filed: Mar. 13, 2023

(65) Prior Publication Data

US 2023/0313390 A1 Oct. 5, 2023

(30) Foreign Application Priority Data

Mar. 11, 2022 (CN) ..... 202210238842.5

(51) Int. Cl.

| | |
|---|---|
| ***C25B 3/25*** | (2021.01) |
| ***C25B 15/08*** | (2006.01) |
| ***C25B 3/03*** | (2021.01) |
| ***C25B 9/19*** | (2021.01) |

(52) U.S. Cl.
CPC ..... *C25B 3/03* (2021.01); *C25B 3/25* (2021.01); *C25B 9/19* (2021.01)

(58) Field of Classification Search
CPC ..... C25B 3/25; C25B 15/08
USPC ..... 205/461, 462
See application file for complete search history.

(56) References Cited

FOREIGN PATENT DOCUMENTS

| | | | | |
|---|---|---|---|---|
| CN | 112301369 A | * | 2/2021 | ..... C25B 11/032 |
| CN | 112853383 A | * | 5/2021 | ..... C25B 3/03 |

OTHER PUBLICATIONS

Huang et al., "Highly Selective Electrochemical Hydrogenation of Acetylene to Ethylene at Ag and Cu Cathodes," Electrochemistry Communications (Sep. 1, 2013), vol. 34, pp. 90-93. (Year: 2013).*

(Continued)

*Primary Examiner* — Edna Wong
(74) *Attorney, Agent, or Firm* — Mark C. Johnson; Johnson Dalal

(57) ABSTRACT

The present disclosure provides a method for generating ethylene by electrochemical selective hydrogenation of acetylene, including the following steps: continuously feeding acetylene gas into an organic solvent at a flow rate of 1 sccm to 50 sccm to obtain a solution; adding an electrolyte in the form of a solution or a solid such that the solution has an electrolyte concentration of 0.1 M to 3 M, a conductivity of 100 $\mu s \cdot cm^{-1}$ to 500 $\mu s \cdot cm^{-1}$, and a current density of 10 $mA \cdot cm^{-2}$ to 300 $mA \cdot cm^{-2}$; adding a hydrogen source such that the solution has a proton concentration of 0.1 M to 28 M; turning on an electrochemical treatment unit, and conducting constant-current or constant-potential electrolysis such that the acetylene gas is continuously and efficiently converted into ethylene gas after the electrolysis is stably conducted. The method has simple operations, low energy consumption, and quick response.

4 Claims, 1 Drawing Sheet

(56) References Cited

OTHER PUBLICATIONS

Strelets et al., "Electrochemically Catalyzed Cleavage of Carbon-Carbon Bond The intermediate Formation of Metal-Carbene Complexes," Journal of Electroanalytical Chemistry and Interfacial Electrochemistry (Jan. 10, 1979), vol. 95, No. 1, pp. 103-108. (Year: 1979).*

Otsuka et al., "An Electrochemical Membrane Reactor for Selective Hydrogenation of Acetylene in Abundant Ethylene," Journal of Catalysis (Feb. 1, 1994), vol. 145, No. 2, pp. 289-294. (Year: 1994).*

Campbell et al., "The Addition of Hydrogen to Multiple Carbon-Carbon Bonds. IV. The Electrolytic Reduction of Alkyl and Aryl Acetylenes," Journal of the American Chemical Society (May 1943), vol. 65, No. 5, pp. 965-967. (Year: 1943).*

* cited by examiner

METHOD FOR GENERATING ETHYLENE BY ELECTROCHEMICAL SELECTIVE HYDROGENATION OF ACETYLENE

CROSS REFERENCE TO RELATED APPLICATION

This patent application claims the benefit and priority of Chinese Patent Application No. 202210238842.5, filed with the China National Intellectual Property Administration on Mar. 11, 2022, the disclosure of which is incorporated by reference herein in its entirety as part of the present application.

TECHNICAL FIELD

The present disclosure relates to the technical fields of petrochemical industry, polymer synthesis, and organic synthesis and other fine chemical industries, in particular to a method for generating ethylene by electrochemical selective hydrogenation of acetylene.

BACKGROUND

With the sustainable growth of the world's population and the continuous advancement of the industrialization process, there is an increasingly growing demand for chemical products such as plastics, rubber, synthetic fibers, and building materials. Ethylene is an important basic chemical raw material, with its annual output being one of the important indicators for evaluating a country's petrochemical level. At present, the production of ethylene mainly depends on the naphtha cracking process, which may lead to the unavoidable mixing of trace acetylene impurities (at 0.5% to 3%) in the ethylene gas stream. These doped trace acetylene impurities can poison the catalyst in a downstream polymer production process, seriously reducing the performance of the catalyst and the quality of the polymerization product. Solvent absorption, complexation absorption, and selective catalytic hydrogenation of acetylene can effectively remove the trace acetylene impurities in ethylene streams.

Compared with the absorption method, the catalytic hydrogenation of acetylene has become the most widely used method in industrial production and laboratory research due to its atomic economy. For example, CN101676025A disclosed a palladium-based catalyst for selective hydrogenation of acetylene, showing desirable conversion and selectivity of acetylene. However, harsh reaction conditions (such as: high temperature, high pressure, and excess hydrogen atmosphere) may lead to excessive hydrogenation and carbon-carbon coupling reactions, while increasing the difficulty of operation; moreover, the palladium-based metal with a loading rate of wt. % to 2 wt. % further increases a cost of the catalyst. CN110841635A disclosed a highly-dispersed Pd-Ag supported acetylene hydrogenation catalyst and a preparation method thereof.

This technology can reduce the amount of palladium-based noble metal catalyst (where Pd accounts for 0.01% to 0.1% and Ag accounts for 0.03% to 1.0%), thus reducing the cost; however, the catalytic hydrogenation of acetylene still requires high temperature and high pressure in a hydrogen atmosphere using this catalyst. CN108147938A and CN111163861A disclosed two methods for generating ethylene by efficient and selective hydrogenation of acetylene through modified catalysts ($Pd_xM_y/SiO_2$ and organic dopant-enhanced palladium catalysts). The method conducts selective hydrogenation on trace amounts of acetylene in an ethylene mixture under the normal pressure, which still depends on high temperature and precious metals.

Therefore, under the current "peak carbon dioxide emissions and carbon neutrality" goal, it is of great significance to develop more efficient, economical, and energy-saving selective hydrogenation technology for the acetylene and ethylene purification process.

SUMMARY

Aiming at the deficiencies in the prior art, the present disclosure creatively provides a method for generating ethylene by electrochemical selective hydrogenation of acetylene. The method avoids the high cost, high energy consumption, and harsh operating conditions existing in the current gas-phase catalytic selective hydrogenation process.

To solve the above technical problems, the present disclosure adopts the following technical solutions:

The present disclosure provides a method for generating ethylene by electrochemical selective hydrogenation of acetylene, including the following steps: continuously feeding acetylene gas or ethylene gas containing a trace amount of acetylene into an organic solvent at a flow rate of 1 sccm to 50 sccm to obtain a solution; adding an electrolyte such that the solution has an electrolyte concentration of 0.1 M to 3 M, a conductivity of 100 $\mu s \cdot cm^{-1}$ to 500 $\mu s \cdot cm^{-1}$, and a current density of 10 $mA \cdot cm^{-2}$ to 300 $mA \cdot cm^{-2}$; adding a hydrogen source such that the solution has a proton concentration of 0.1 M to 28 M; turning on an electrochemical treatment unit, and conducting constant-current or constant-potential electrolysis such that the acetylene gas is continuously and efficiently converted into polymer-grade ethylene gas after the electrolysis is stably conducted.

Further, the acetylene gas or the ethylene gas containing a trace amount of acetylene is flow controlled by a gas mass flow controller, and then continuously flowed into the organic solvent at a flow rate of 1 sccm to 50 sccm.

Further, the organic solvent is one or more selected from the group consisting of N,N-dimethylformamide (DMF), N-methylpyrrolidone (NMP), formic acid, acetic acid, dimethyl sulfoxide (DMSO), ethyl acetate, acetone, glycerol, ethylene glycol, methanol, and isopropanol.

Further, the hydrogen source is one or more selected from the group consisting of water, oxalic acid, acetic acid, formic acid, ascorbic acid, boric acid, citric acid, isopropanol, glycerol, ethanol, and methanol.

Further, the electrolyte is one or more selected from the group consisting of tetrafluoroborate, tetrabutyltetrafluoroborate, tetraethyltetrafluoroborate, tetramethyltetrafluoroborate, 1-propyl-3-methylimidazolium tetrafluoroborate, tetraethyl chloride, tetrabutyl chloride, tetrabutylphosphonium tetrafluoroborate, and triethylmethylammonium tetrafluoroborate. The conductivity in an electrolytic cell can be increased by adding the electrolyte, thereby further promoting the electrochemical reduction.

The tetrafluoroborate includes ammonium tetrafluoroborate, sodium tetrafluoroborate, and potassium tetrafluoroborate; the tetrabutyltetrafluoroborate includes ammonium tetrabutyltetrafluoroborate; the tetraethyltetrafluoroborate includes ammonium tetraethyltetrafluoroborate; the tetramethyltetrafluoroborate includes ammonium tetramethyltetrafluoroborate; the tetraethyltetrafluoroborate includes ammonium tetraethyltetrafluoroborate; the 1-propyl-3-methylimidazolium tetrafluoroborate includes ammonium 1-propyl-3-methylimidazolium tetrafluoroborate; the tetraethyl chloride includes tetraethyl ammonium chloride; the tetrabutyl chloride includes tetrabutyl ammonium chloride;

the tetrabutylphosphonium tetrafluoroborate includes ammonium tetrabutylphosphonium tetrafluoroborate; and the triethylmethylammonium tetrafluoroborate includes ammonium triethylmethylammonium tetrafluoroborate.

Further, the electrolyte is directly added in the form of a solid or added in the form of a pre-solution.

Further, the electrochemical treatment unit is one or more selected from the group consisting of a single-chamber electrochemical treatment unit and a double-chamber electrochemical treatment unit; in a case of a large flow feed, namely, a flow rate >100 mL/min, it is impossible for a single cell to achieve 100% acetylene conversion, and multiple cells in series are used for stable, continuous, and efficient selective hydrogenation of acetylene after the electrochemical treatment is conducted for 30 min.

Further, when the double-chamber electrochemical treatment unit is used, cathode and anode chambers are divided by one or more of a proton membrane, a cationic membrane, and an anionic membrane; and an electrolyte of the anode chamber is an aqueous solution of one or more selected from the group consisting of sulfide, sulfate, hydroxide, nitrate, chloride, carbonate, and oxalate.

The sulfide includes magnesium sulfide and zinc sulfide; the sulfate includes sodium sulfate, magnesium sulfate, and zinc sulfate; the hydroxide includes sodium hydroxide and potassium hydroxide; the nitrate includes sodium nitrate, ferric nitrate, magnesium nitrate, and zinc nitrate; the chloride includes sodium chloride, potassium chloride, and magnesium chloride; the carbonate includes sodium carbonate; and the oxalate includes sodium oxalate, magnesium oxalate, and zinc oxalate.

Further, in the electrochemical treatment unit, the anode is one or more selected from the group consisting of a metal electrode, a non-metal electrode, and a metal/non-metal composite modified electrode. The metal electrode is selected from the group consisting of a single metal electrode, a bimetal alloy electrode, and a polymetallic alloy electrode, the metal is a metal element in the IVB-VIB metals of the periodic table, and a shape of the metal electrode includes a wire, a rod, a sheet shape, or a plate; the non-metal electrode includes a ceramic electrode and a carbon-based electrode, and the carbon-based electrode is a graphite electrode, an activated carbon electrode, a carbon fiber electrode, a carbon nanomaterial electrode, or a graphene electrode, and a shape of the electrode includes a filament, a rod, a plate, or a sponge (such as: a carbon fiber paper electrode, an activated carbon-doped polytetrafluoroethylene (PTFE) electrode, and a heteroatom (including nitrogen, phosphorus, boron, sulfur, and oxygen)-doped porous activated carbon electrode); the composite modified electrode is one or more mixed modified electrodes selected from the group consisting of a mono-metal, a bimetallic alloy, a polymetallic alloy, a monometallic oxide, a bimetallic oxide, a polymetallic oxide, a monometallic hydroxide, a bimetallic hydroxide, a polymetallic hydroxide, multidimensional carbon (such as: fullerene, graphene, carbon nanotubes, and biochar), and heteroatom-modified multidimensional carbon, including a copper-supported fullerene electrode and a platinum-supported and nitrogen-modified carbon nanotube electrode.

Further, in the electrochemical treatment unit, the cathode is one or more selected from the group consisting of a single metal electrode, an alloy electrode, a non-metal electrode, and a composite load electrode.

The single-metal electrode is a metal electrode of palladium, gold, copper, nickel, and rhodium, and the metal electrode is in the shape of a ball, a foam, a ring, a brush, a wire, a wire, a sheet, a rod, or a plate, as well as a nanowire, a nanoarray, a nanofilament, a nanoparticle, a nanosheet, and a nanorod; the alloy electrode is an electrode of low-entropy alloys, medium-entropy alloys, and high-entropy alloys composed of palladium, gold, silver, copper, nickel, rhodium, cobalt, gallium, zinc, tin, indium, and platinum, including a rhodium-nickel alloy electrode, a palladium-copper-silver low-entropy alloy electrode, a palladium-copper-zinc-cobalt medium-entropy alloy, and a palladium-copper-silver-zinc-nickel high-entropy alloy; the non-metal electrode is selected from the group consisting of a ceramic electrode and a carbon-based material electrode; and the composite load electrode is a carbon-based electrode supported by one or more of the above metals (such as: a graphite electrode, a carbon nanotube electrode, a covalent organic frameworks electrode, a graphene electrode, and a heteroatom (nitrogen, phosphorus, boron, sulfur, and oxygen)-modified carbon electrode), and a metal oxide (such as: cerium oxide, aluminum oxide, silicon dioxide, and titanium dioxide).

Compared with the Prior Art, the Present Disclosure has the Following Beneficial Effects:

1. In the present disclosure, a new method for generating ethylene by continuous electrochemical selective hydrogenation of acetylene in a room-temperature liquid phase is used to achieve the mild and selective hydrogenation of acetylene under room temperature and pressure in a liquid phase without feeding hydrogen gas. The method transforms a high-temperature and high-pressure gas phase paradigm reaction (traditional catalytic hydrogenation of acetylene) into a room-temperature and normal-pressure liquid phase reaction. The method has simple operation and process, strong selectivity to acetylene, and high hydrogenation rate, can be popularized in large-scale projects, and has desirable application prospects.
2. In the present disclosure, solvent selective absorption is coupled with electrochemical reduction hydrogenation, such that electrochemical selective catalytic hydrogenation can be realized in situ while acetylene is dissolved, so as to efficiently generate ethylene. Meanwhile, due to the low solubility of ethylene, the excessive hydrogenation of acetylene/ethylene and the carbon-carbon coupling reactions of acetylene are effectively avoided. The coupling and synergy of the two methods can realize the efficient absorption and selective hydrogenation of acetylene under different feed environments.
3. Under the same conditions, compared with the solvent absorption, the method of the present disclosure increases a purification efficiency of ethylene gas flow by 2 to 3 times, without saturated absorption, which can continuously realize the purification and separation of mixed gas including ethylene and acetylene. Compared with an electrochemical reduction system not combined with the solvent absorption, an efficiency of the method for purifying the ethylene gas flow is nearly doubled, thus greatly improving a conversion efficiency of acetylene. Therefore, the method improves the selectivity of converting acetylene to ethylene, greatly shortens the time for ethylene purification and selective hydrogenation of acetylene, and improves reaction efficiency.
4. In the present disclosure, an organic solvent commonly used in the chemical industry is adopted, showing low cost and simple operation; a conventional pumping method is compatible with the existing process to reduce the construction cost.

5. In the present disclosure, in addition to the noble metal catalysts such as Pd and Au commonly used in catalytic hydrogenation, cheap metals such as copper can also be used for the electrochemical hydrogenation, which significantly reduces the cost of catalyst manufacture and use. Moreover, the selective hydrogenation of acetylene can be completed with only a small input of energy, which has reduced energy consumption and high reaction rate. The continuous gas feeding process can realize the efficient, stable, and continuous conversion of acetylene to ethylene within 30 min.
6. Compared with the relatively expensive petroleum-to-ethylene method, the method of the present disclosure can also be directly combined with natural gas/coal-to-acetylene technology to directly produce high-quality ethylene.

DETAILED DESCRIPTION OF THE EMBODIMENTS

Figure 1:
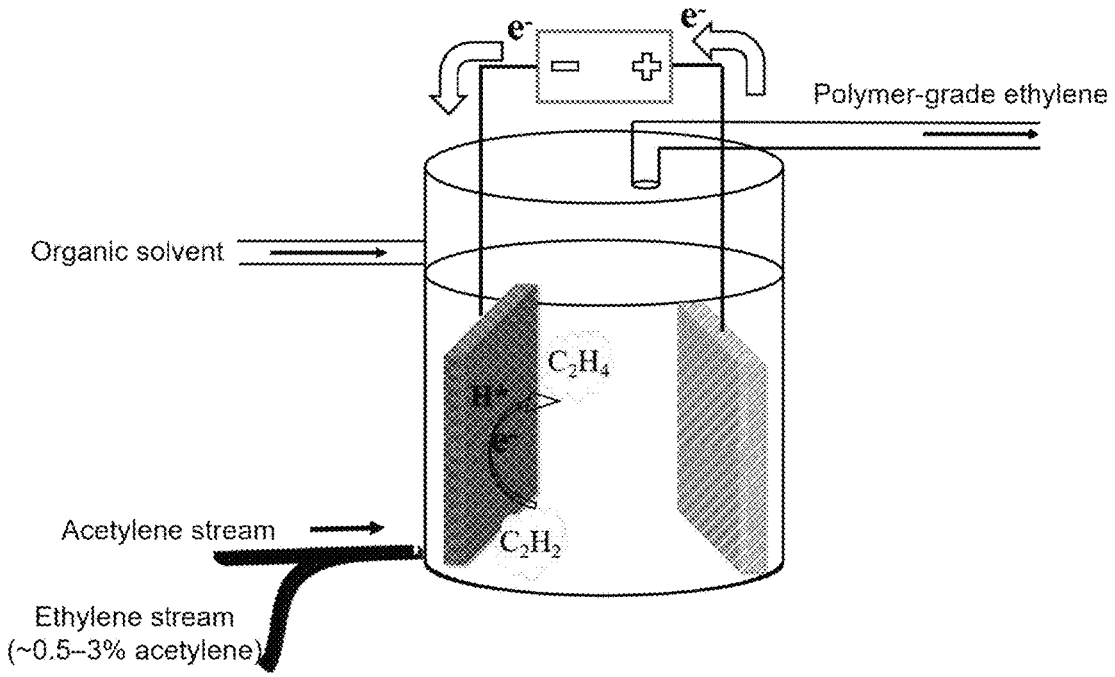
FIG. 1 is a flowchart of the process according to the present disclosure.

To enable a person skilled in the art to better understand technical solutions of the present disclosure, the present disclosure is further described below in detail with reference to the specific examples and accompanying drawings, which are not limited thereto.

Acetylene conversion (%)=(inlet acetylene content−outlet acetylene content)/inlet acetylene content×100%;

Ethylene selectivity (%)=outlet ethylene content/(inlet acetylene content−outlet acetylene content)×100%.

The acetylene gas or the ethylene gas containing a trace amount of acetylene is continuously fed into a reaction unit at a flow rate of 1 sccm to 50 sccm, a current density of 10 $mA \cdot cm^{-2}$ to 300 $mA \cdot cm^{-2}$, and an electrolyte concentration of 0.1 M to 3 M to obtain a solution. A hydrogen source is added such that a proton concentration in the solution reach 0.1 M to 28 M, and a power supply of an electrochemical treatment unit is turned on, such that the trace acetylene gas in ethylene is selectively converted into ethylene gas after the electrolysis is stably conducted; alternatively, the acetylene gas produced by the coal chemical industry is directly subjected to selective hydrogenation to continuously generate ethylene.

When the feed is ethylene gas containing acetylene impurities, under the action of the solvent, the acetylene impurity molecules are selectively dissolved in the solvent (formula (1)), and then diffused to an electrode surface to achieve a dynamic equilibrium. Under the electrochemical action, the dissolved acetylene molecules in the electrolyte can quickly transfer mass, reach and disperse in a Helmholtz layer of the cathode (formula (2)); after overcoming the mass transfer resistance at the electrode interface, ethylene gas is generated at the cathode through a direct electron transfer-coupled proton transfer process (formulas (3) and (4)) and/or an active hydrogen-induced indirect electron transfer path (formulas (5) and (6)). Due to the use of a selective cathode, ethylene can quickly escape from the cathode and an inner Helmholtz layer (formula (7)), and the solvent with a low solubility of ethylene further accelerates the escape of ethylene from the liquid phase to enter the gas phase. Accordingly, the electrochemical selective hydrogenation of acetylene to ethylene is realized under room temperature and normal pressure in a liquid phase without noble metal catalysts or hydrogen atmosphere, thus purifying the ethylene gas. When combined with coal chemical technology, the acetylene gas is directly fed to conduct electrochemical electrolysis. Due to the high solubility to acetylene and the low solubility to ethylene of the organic solvent, the mass transfer of gas, solid, and liquid interfaces can be significantly promoted, thereby greatly promoting the electrochemical interfacial reaction, and improving the efficiency and selectivity of the electroreduction hydrogenation of acetylene. The subsequent purification unit can effectively remove trace impurities (such as oxygen and hydrogen) generated during the electrolysis, so as to finally obtain high-purity ethylene gas. The coupling system has a better treatment efficiency of acetylene than that of the traditional gas-phase catalytic hydrogenation of acetylene, which realizes the high-efficiency and high-selectivity generation of ethylene from acetylene under room temperature and normal pressure using a mild hydrogen source (water) with non-noble metal catalysts in the liquid phase.

Dissolving Process:

$$C_2H_2(g) \leftrightarrow C_2H_2(1) \quad (1)$$

Cathode Reactions:

$$C_2H_2(1) \rightarrow M\text{-}{*}C_2H_2(1) \quad (2)$$

$$M\text{-}{*}C_2H_2(1)+2H_2O+2e^- \rightarrow M\text{-}{*}C_2H_4(1)+2OH^- \quad (3)$$

$$M\text{-}H_2O(1)+e^- \rightarrow M\text{-}H^*(1)+OH^- \quad (4)$$

$$M\text{-}{*}C_2H_2(1)+M\text{-}H^*+e^- \rightarrow M\text{-}{*}C_2H_3(1)+OH^- \quad (5)$$

$$M\text{-}{*}C_2H_3(1)+M\text{-}H^*+e^- \rightarrow M\text{-}{*}C_2H_4(1)+OH^- \quad (6)$$

Gas-Liquid Separation:

$$M\text{-}{*}C_2H_4(1) \rightarrow C_2H_4(g) \quad (7)$$

Example 1

Acetylene gas was continuously fed into a reaction chamber containing a solvent absorption liquid to obtain a solution. An electrolyte was injected such that an electrolyte concentration in the solution reached 0.1 M. A hydrogen source was added such that a proton concentration in the solution reached 5 M, and a power supply was turned on. Electrochemical selective hydrogenation was conducted at a current density of 40 $mA \cdot cm^{-2}$ under room temperature and normal pressure for 30 min, and samples were stably released for sample collection.

In this example, the solvent was DMF, the hydrogen source was pure water, and the electrolyte was tetrabutyltetrafluoroborate. The tetrabutyltetrafluoroborate was ammonium tetrabutyltetrafluoroborate added in the form of a solid. An electrode reactor included a graphite sheet electrode as an anode and a sulfur-modified foam copper electrode as a cathode.

Example 2

Acetylene gas was continuously fed into a reaction chamber containing a solvent absorption liquid to obtain a solution, an electrolyte was injected such that an electrolyte concentration in the solution reached 0.1 M, a hydrogen source was added such that a proton concentration in the solution reached 5 M, a power supply was turned on, and electrochemical selective hydrogenation was conducted at a current density of 40 $mA \cdot cm^{-2}$ under room temperature and normal pressure for 30 min, and samples were stably released for sample collection.

In this example, the solvent was NMP, the hydrogen source was pure water, and the electrolyte was tetrabutyltetrafluoroborate; the tetrabutyltetrafluoroborate was ammonium tetrabutyltetrafluoroborate added in the form of a solid; and an electrode reactor included a graphite sheet electrode as an anode and a sulfur-modified foam copper electrode as a cathode.

Example 3

Acetylene gas was continuously fed into a reaction chamber containing a solvent absorption liquid to obtain a solution. An electrolyte was injected such that an electrolyte concentration in the solution reached 0.1 M. A hydrogen source was added such that a proton concentration in the solution reached 5 M, and a power supply was turned on. Electrochemical selective hydrogenation was conducted at a current density of 20 $mA \cdot cm^{-2}$ under room temperature and normal pressure for 30 min, and samples were stably released for sample collection.

In this example, the solvent was DMF, the hydrogen source was pure water, and the electrolyte was tetrabutyltetrafluoroborate; the tetrabutyltetrafluoroborate was ammonium tetrabutyltetrafluoroborate added in the form of a solid; and an electrode reactor included a graphite sheet electrode as an anode and a sulfur-modified foam copper electrode as a cathode.

Example 4

Acetylene gas was continuously fed into a reaction chamber containing a solvent absorption liquid to obtain a solution, an electrolyte was injected such that an electrolyte concentration in the solution reached 0.1 M, a hydrogen source was added such that a proton concentration in the solution reached 5 M, a power supply was turned on, and electrochemical selective hydrogenation was conducted at a current density of 40 $mA \cdot cm^{-2}$ under room temperature and normal pressure for 30 min, and samples were stably released for sample collection.

In this example, the solvent was DMF, the hydrogen source was pure water, and the electrolyte was tetraethyltetrafluoroborate; the tetraethyltetrafluoroborate was ammonium tetraethyltetrafluoroborate added in the form of a solid; and an electrode reactor included a graphite sheet electrode as an anode and a sulfur-modified foam copper electrode as a cathode.

Example 5

Acetylene gas was continuously fed into a reaction chamber containing a solvent absorption liquid to obtain a solution, an electrolyte was injected such that an electrolyte concentration in the solution reached 0.1 M, a hydrogen source was added such that a proton concentration in the solution reached 16.7 M, a power supply was turned on, and electrochemical selective hydrogenation was conducted at a current density of 40 $mA \cdot cm^{-2}$ under room temperature and normal pressure for 30 min, and samples were stably released for sample collection.

In this example, the solvent was NMP, the hydrogen source was pure water, and the electrolyte was tetrabutyltetrafluoroborate; the tetrabutyltetrafluoroborate was ammonium tetrabutyltetrafluoroborate added in the form of a solid; and an electrode reactor included a graphite sheet electrode as an anode and a sulfur-modified foam copper electrode as a cathode.

Example 6

Acetylene gas was continuously fed into a reaction chamber containing a solvent absorption liquid to obtain a solution, an electrolyte was injected such that an electrolyte concentration in the solution reached 0.1 M, a hydrogen source was added such that a proton concentration in the solution reached 16.7 M, a power supply was turned on, and electrochemical selective hydrogenation was conducted at a current density of 40 $mA \cdot cm^{-2}$ under room temperature and normal pressure for 30 min, and samples were stably released for sample collection.

In this example, the solvent was NMP, the hydrogen source was pure water, and the electrolyte was tetrabutyltetrafluoroborate; the tetrabutyltetrafluoroborate was ammonium tetrabutyltetrafluoroborate added in the form of a solid; and an electrode reactor included a graphite sheet electrode as an anode and a copper sheet electrode as a cathode.

Comparative Example 1

Acetylene gas was continuously fed into a reaction chamber containing a solvent absorption liquid to obtain a solution, an electrolyte was injected such that an electrolyte concentration in the solution reached 0.1 M, a hydrogen source was added such that a proton concentration in the solution reached 55.6 M, a power supply was turned on, and electrochemical selective hydrogenation was conducted at a current density of 40 $mA \cdot cm^{-2}$ under room temperature and normal pressure for 30 min, and samples were stably released for sample collection.

In this example, the solvent was water, and the electrolyte was potassium hydroxide added in the form of a solid; and an electrode reactor included a graphite sheet electrode as an anode and a sulfur-modified foam copper electrode as a cathode.

In a specific implementation process, the organic solvent was one or more selected from the group consisting of DMF, NMP, formic acid, acetic acid, DMSO, ethyl acetate, acetone, glycerol, ethylene glycol, methanol, and isopropanol; the hydrogen source was one or more selected from the group consisting of water, oxalic acid, acetic acid, formic acid, ascorbic acid, boric acid, citric acid, isopropanol, glycerol, ethanol, and methanol; and the electrolyte was one or more selected from the group consisting of tetrafluoroborate, tetrabutyltetrafluoroborate, tetraethyltetrafluorob orate, tetramethyltetrafluoroborate, 1-propyl-3-methylimidazolium tetrafluoroborate, tetraethyl chloride, tetrabutyl chloride, tetrabutylphosphonium tetrafluoroborate, and triethylmethylammonium tetrafluoroborate, which all can achieve similar experimental results.

The comparison of solvents, electrolytes, and hydrogen sources added in Examples 1 to 6 and Comparative example 1, as well as current densities were shown in Table 1.

TABLE 1

| Examples/ Comparative example | Solvent | Electrolyte | Hydrogen source and its concentration | Anode | Cathode | Current density ($mA \cdot cm^{-2}$) |
|---|---|---|---|---|---|---|
| Example 1 | DMF | Ammonium tetrabutyltetra fluoroborate | Water 5M | Graphite sheet | Sulfur-modified foam copper | 40 |
| Example 2 | NMP | Ammonium tetrabutyltetra fluoroborate | Water 5M | Graphite sheet | Sulfur-modified foam copper | 40 |
| Example 3 | DMF | Ammonium tetrabutyltetra fluoroborate | Water 5M | Graphite sheet | Sulfur-modified foam copper | 20 |
| Example 4 | DMF | Ammonium tetrabutyltetra fluoroborate | Water 5M | Graphite sheet | Sulfur-modified foam copper | 40 |
| Example 5 | NMP | Ammonium tetrabutyltetra fluoroborate | Water 16.7M | Graphite sheet | Sulfur-modified foam copper | 40 |
| Example 6 | NMP | Ammonium tetrabutyltetra fluoroborate | Water 16.7M | Graphite sheet | Copper sheet | 40 |
| Comparative example 1 | Water | KOH | Water 55.6M | Graphite sheet | Sulfur-modified foam copper | 40 |

Figure 2:
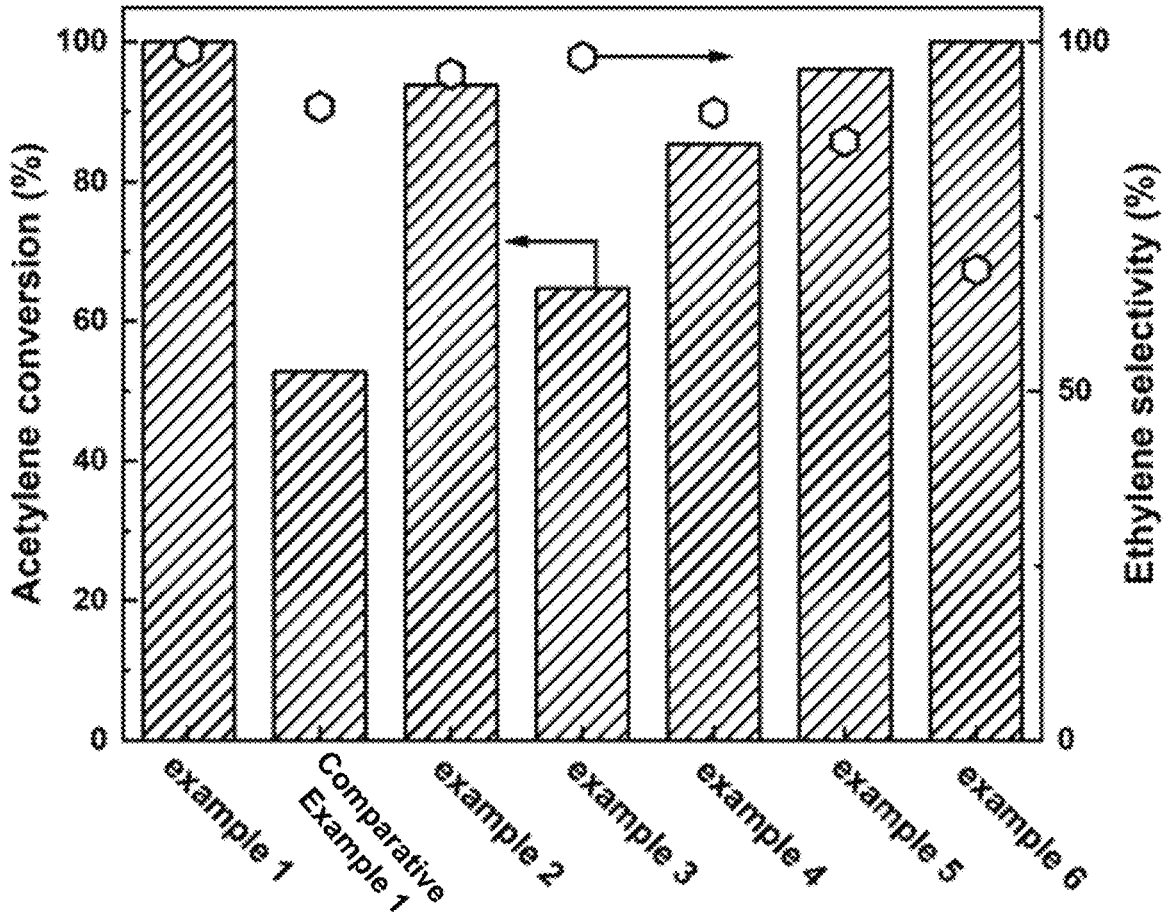
FIG. 2 shows acetylene conversion/ethylene selectivity under different conditions in the present disclosure.

The changes in the concentration of acetylene in Examples 1 to 6 and Comparative example 1 were recorded, and the acetylene conversion and the ethylene selectivity were calculated, as shown in FIG. 2.

It was seen from FIG. 2 and Table 1 that:

1) When the cathode materials were different while other conditions were the same, such as in Example 5 and Example 6: compared with the copper electrode as the cathode material, the sulfur-modified copper foam electrode as the cathode material had a higher selectivity to generate ethylene with lower acetylene conversion.
2) When the water contents of the hydrogen source were different while other conditions were the same, such as Example 2 and Example 5: a lower water content led to higher selectivity of ethylene formation and similar acetylene conversion.
3) When the electrolytes were different while other conditions were the same, such as in Example 1 and Example 4: compared with ammonium tetraethyltetrafluoroborate, ammonium tetrabutyltetrafluoroborate was more suitable for liquid-phase hydrogenation of the acetylene; after using the ammonium tetrabutyltetrafluoroborate as the electrolyte, the acetylene conversion and the ethylene selectivity each were higher than those of the ammonium tetraethyltetrafluoroborate.
4) When the types of solvents were different while other conditions were the same, such as in Example 1 and Example 2: compared with NMP, DMF was more suitable for liquid-phase hydrogenation of acetylene; after using the DMF as the solvent, the acetylene conversion and the ethylene selectivity each were higher. This might be due to the fact that DMF had a better solvent capacity for acetylene, which dissolved more acetylene per unit time and accelerated the reaction.
5) When the current densities were different while other conditions were the same, such as in Example 3 and Example 4: with an increase of the current density, the acetylene conversion was significantly increased, and the ethylene selectivity was slightly decreased.
6) In addition, under the same conditions, the organic solvent (Example 1) significantly increased the acetylene conversion compared with that of no solvent absorption unit (Comparative example 1), and the acetylene conversion within 1 h increased by about 45%, with selectivity also being improved. This reflected the superiority of the present disclosure, that is, an organic solvent as a reaction medium could significantly change the liquid-phase selective hydrogenation catalytic process of acetylene.

To sum up, the present disclosure proposes a method for generating ethylene by electrochemical selective hydrogenation of acetylene, which realizes the selective hydrogenation of acetylene to ethylene under room temperature and normal pressure in a liquid phase without hydrogen or noble metal catalysts, as well as the selective hydrogenation purification of traces of acetylene in ethylene streams.

The above described are merely preferred embodiments of the present disclosure, and not intended to limit the present disclosure. Any modifications, equivalent replacements and improvements made within the spirit and principle of the present disclosure should all fall within the scope of protection of the present disclosure.

What is claimed is:

1. A method for generating ethylene by electrochemical selective hydrogenation of acetylene, comprising the following steps:

continuously feeding acetylene gas or ethylene gas containing a trace amount of acetylene into an organic solvent at a flow rate of 1 sccm to 50 sccm to obtain a solution;

adding an electrolyte to the solution such that the solution has an electrolyte concentration of 0.1 M to 3 M, a conductivity of 100 μs·cm−1 to 500 μs·cm−1, and a current density of 40 mA·cm−2 to 300 mA·cm−2; adding a hydrogen source to the solution such that the solution has a proton concentration of 0.1 M to 5 M;

conducting constant-current electrolysis in an electrochemical treatment unit such that the acetylene gas or the trace amount of acetylene contained in the ethylene gas is continuously and efficiently converted into polymer-grade ethylene gas after the constant current electrolysis is stably conducted, wherein the organic solvent is N,N-dimethylformamide (DMF) or N-methylpyrrolidone (NMP);

the electrolyte is ammonium tetrabutyltetrafluoroborate;

the hydrogen source is water;

a cathode for the electrochemical treatment unit is sulfur-modified foam copper;

an anode for the electrochemical treatment unit is graphite sheet; and the electrochemical treatment unit is a single-chamber electrochemical treatment unit.

2. The method for generating ethylene by electrochemical selective hydrogenation of acetylene according to claim 1, wherein the flow rate of the acetylene gas or the ethylene gas containing a trace amount of acetylene is controlled by a gas mass flow controller.

3. The method for generating ethylene by electrochemical selective hydrogenation of acetylene according to claim 1, wherein the electrolyte is directly added in the form of a solid or added in the form of a pre-solution.

4. The method for generating ethylene by electrochemical selective hydrogenation of acetylene according to claim 1, wherein under the condition that 100% acetylene conversion is not achieved in one single-chamber electrochemical treatment unit, the constant-current electrolysis is conducted in multiple single-chamber electrochemical treatment units in series.

* * * * *